US008132311B1

(12) United States Patent
Nitkin

(10) Patent No.: US 8,132,311 B1
(45) Date of Patent: Mar. 13, 2012

(54) LUGGAGE WITH GRAFFITI PATTERNS AND METHOD OF MANUFACTURING SAME

(76) Inventor: Andrew Nitkin, New York, NY (US)

( * ) Notice: Subject to any disclaimer, the term of this patent is extended or adjusted under 35 U.S.C. 154(b) by 551 days.

(21) Appl. No.: 12/263,961

(22) Filed: Nov. 3, 2008

Related U.S. Application Data

(60) Provisional application No. 60/984,765, filed on Nov. 2, 2007.

(51) Int. Cl.
*B23P 25/00* (2006.01)

(52) U.S. Cl. ..... 29/458

(58) Field of Classification Search ..... 29/458, 29/416, 417, 428, 419.1, 425; 446/268; 190/125, 190/124
See application file for complete search history.

(56) References Cited

U.S. PATENT DOCUMENTS

2010/0075569 A1* 3/2010 Carnegie ..... 446/268
* cited by examiner

*Primary Examiner* — John C Hong

(57) ABSTRACT

A method for fabricating a unit of luggage includes photographing one or more graffiti scenes, photographically processing the resulting images to yield a composite design image, transferring the composite design image to a sheet of fabric material in a repeating design, cutting the fabric to form pieces of the luggage unit and joining the cut pieces form the luggage unit.

7 Claims, 4 Drawing Sheets

LUGGAGE WITH GRAFFITI PATTERNS AND METHOD OF MANUFACTURING SAME

CROSS REFERENCE TO RELATED APPLICATION

This application claims priority from U.S. Provisional Patent Application Ser. No. 60/984,765 entitled "Luggage With Graffiti Patterns," filed Nov. 2, 2007. The disclosure in that provisional patent application is incorporated herein by reference in its entirety.

BACKGROUND

1. Technical Field

The present invention pertains to an improvement in luggage and methods of manufacturing luggage.

2. Discussion of the Related Art

It is known to manufacture luggage with surface panels of decorative designs. Typically, this is done using a fabric of cloth into which the design is woven. The fabric may be impregnated with plastic or rubberized material where the fabric is initially made with the desired design. Various types of flexible plastic or rubber, canvas or nylon material are also used. For example, reference is made U.S. Pat. No. 5,307,908 (Shyr et al). The disclosure in that patent is incorporated herein in its entirety. Other patents of background interest are U.S. Pat. Nos. 7,147,089 (Godshaw et al), 4,325,469 (Gurian) and 6,637,562 (Oh), the disclosures in which are incorporated herein in their entireties.

It has occurred to the present inventor that common street graffiti designs would make attractive patterns for luggage material. However, there has not heretofore been available an economical method of transferring such designs to material that can be used for luggage.

SUMMARY OF THE INVENTION

The present invention, in its broadest context, involves luggage made of material bearing street graffiti designs and, in particular, a method of imprinting street graffiti images on luggage material. The method involves taking photographs of various street graffiti scenes to be used, processing the photograph(s) of the graffiti scene or scenes to arrive at a desired design, transferring the processed photograph to a fabric of woven or non-woven cloth material in a repeating pattern, applying a desired backing to the material, cutting the material according to a prescribed pattern to form panels of the final luggage product, and joining the cut panels to form the final product.

DETAILED DESCRIPTION OF THE INVENTION

Figure 1:
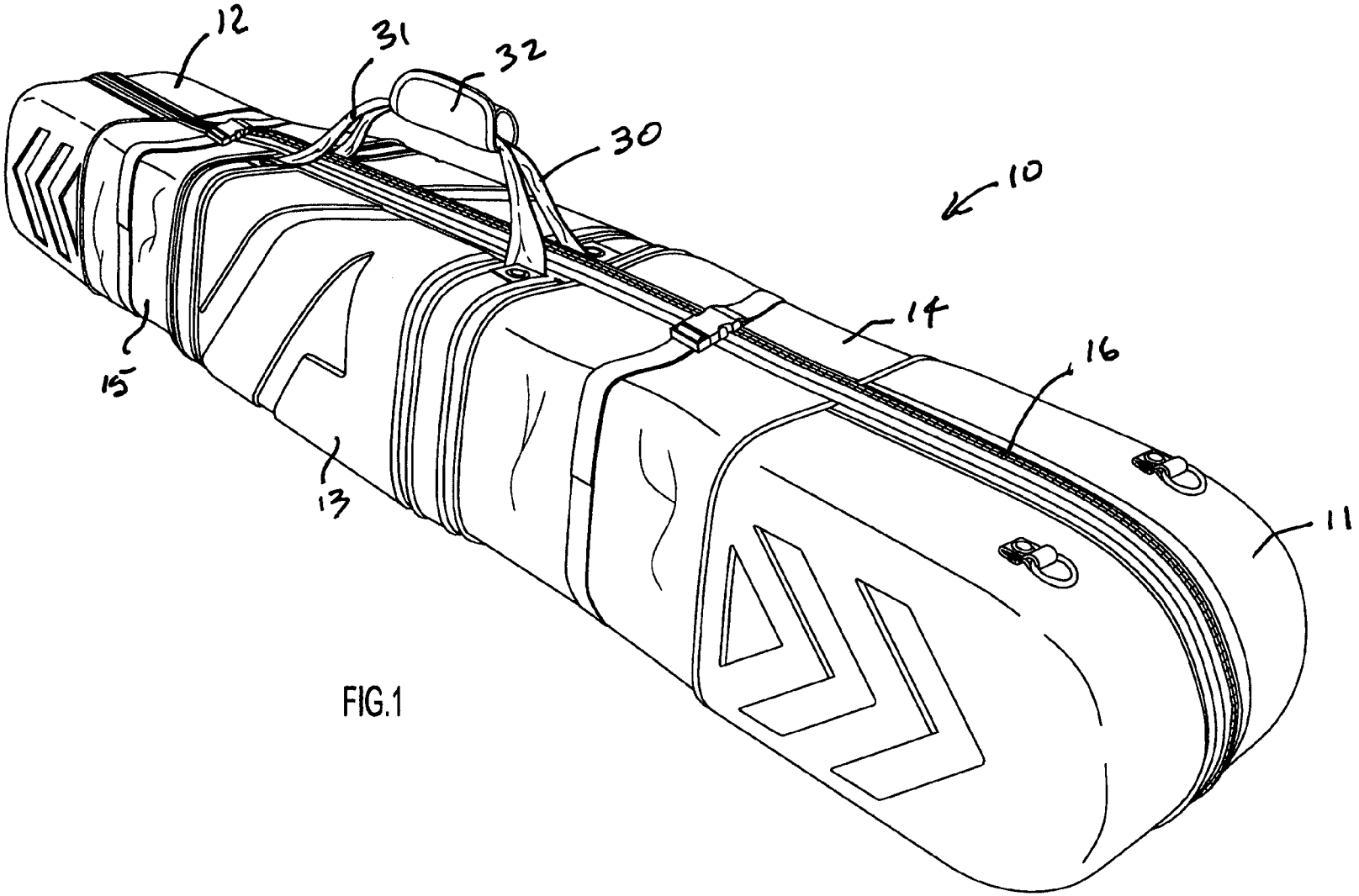
FIG. 1 is a top front view in perspective showing a luggage unit fabricated according to the method of the present invention.
Figure 2:
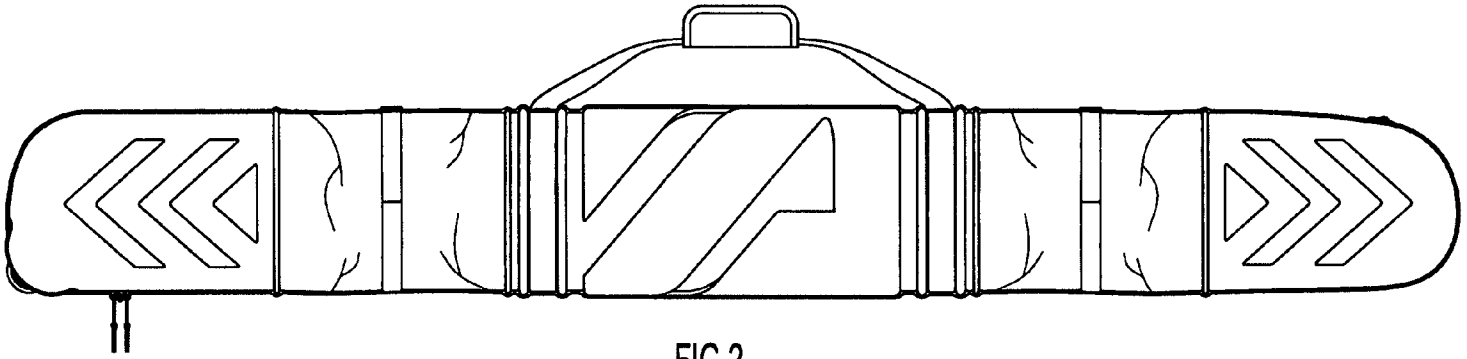
FIG. 2 is a top rear view in perspective showing the luggage unit of FIG. 1.
Figure 3:
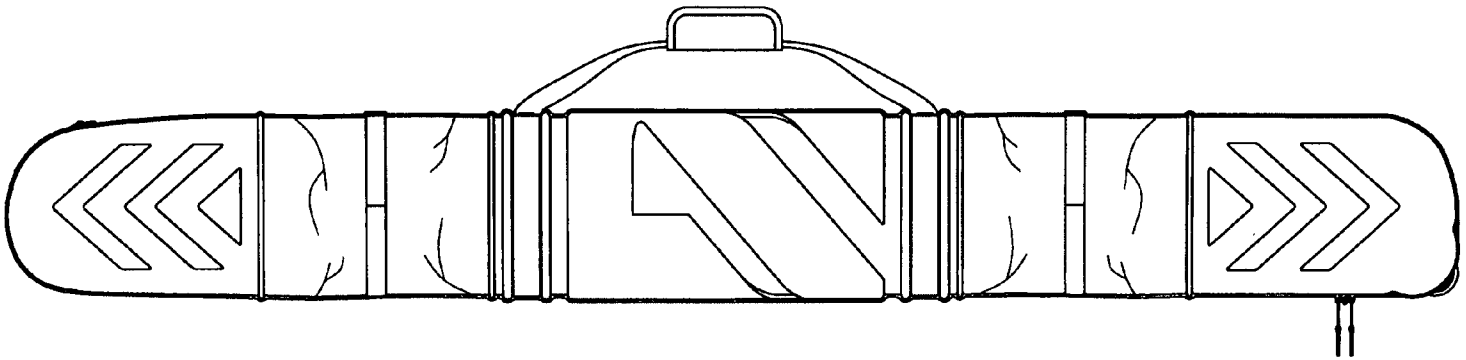
FIG. 3 is a top side view in perspective of the luggage unit of FIG. 1 with the side flap open.
Figure 4:
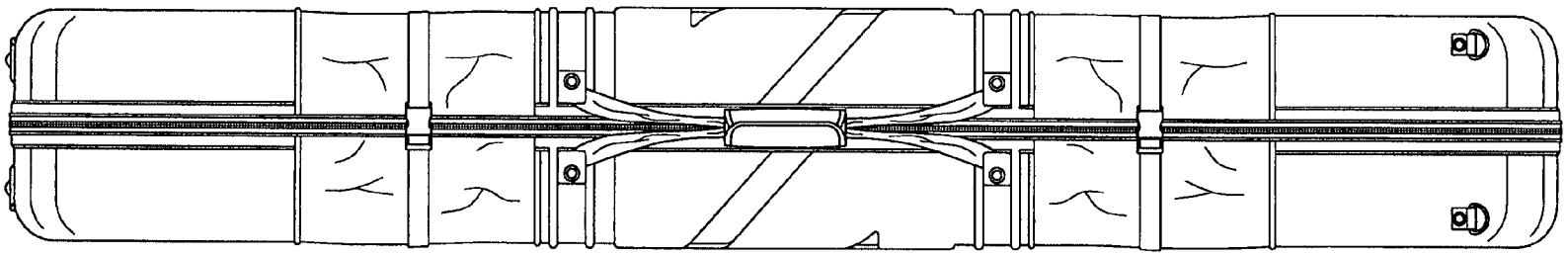
FIG. 4 is a top view in plan of the unit of FIG. 1 showing the unit open.
Figure 5:
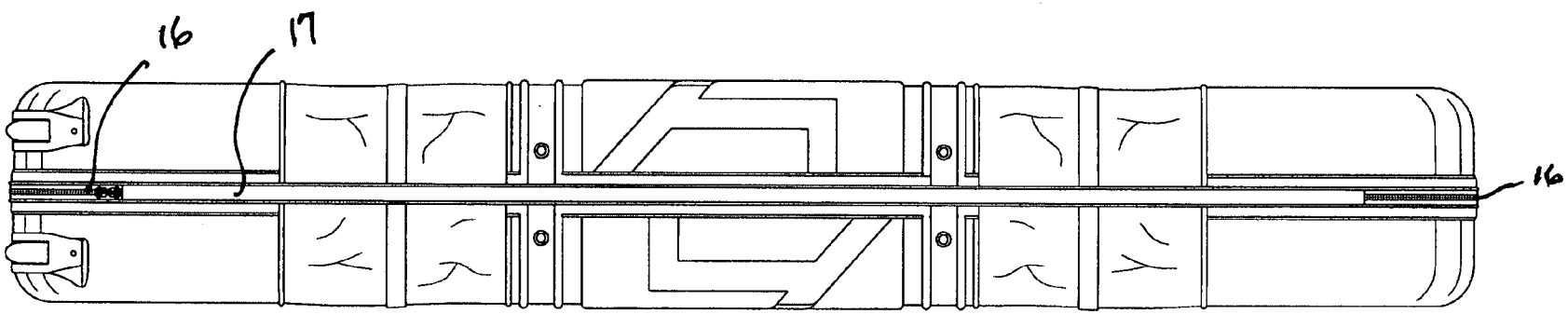
FIG. 5 in an end view in perspective of the unit of FIG. 1.

The following detailed explanations of FIGS. 1-7 and of the preferred embodiments reveal the methods and apparatus of the present invention.

In accordance with the present invention, a luggage unit is designed by first selecting one or more visually appealing street graffiti scenes. Suitable scenes are typically in public view on substantially flat surfaces of buildings, fences or other structures. Although the surface bearing the graffiti can be contoured (i.e., other than flat), too much non-flat contour will, in most cases, detract from the desired overall design. Likewise, the color of the base surface must be considered with respect to how it impacts the graffiti appearing thereon and the ultimate final design. Selecting graffiti scenes, is, of course, dependent upon the subjective taste of the luggage manufacturer.

Once the graffiti scenes are selected, several photographs (preferably digital) are taken of each selected graffiti scene. The photographs are preferably taken from a line of sight perpendicular to the surface bearing the graffiti, although for some designs off-angle perspective views may be desirable. It has been found that when plural graffiti scenes are to be combined as one design, it is best that the photos of all of the combined scenes be taken from the same angle relative to the base surface, and the angle that yields the best results is perpendicular to the base surface since that makes it is easier to combine the images during processing. Nevertheless, for some designs, different lines of sight may be employed.

The several photographs are then studied from an artistic point of view to determine how they may be best combined to yield a final design that will be eye-appealing to purchasers of luggage units. The individual photographic images are then photographically processed and then combined as desired to result in a composite visually appealing work of art. The processing of the images involves artistic preference and talent and depends on subjective preferences. The processing technology employed is not limited, and one common technology for accomplishing this is the commercially available Adobe Photoshop software. The editing may include cropping and/or changing color, tint, brightness, contrast, focus, etc. Typically, the selected images are stored on a disc and combined or processed in the desired manner into a final design image.

The final design image is then transferred to a fabric of woven or non-woven cloth material in a repeating pattern. The transfer of the image to the cloth material, is preferably done by conventional roller printing techniques wherein the combined and processed digital image contained on a disc is engraved onto a roller containing a paste or other material for each color. A white fabric is then passed by the roller and receives a repeating pattern of the image/design. Alternatively, other image transfer techniques, such as in mold printing, may also be used for this step.

The next step in the process is applying a backing to the cloth material onto which the image pattern has been transferred. The application of the backing material is conventional in the art as is described in the patents cited herein in the Background section. The backed material is then cut from the roll into pieces of prescribed configurations in accordance with predetermined patterns required to form the individual panels of a luggage unit. This cuffing results in random parts of the repeating pattern being selected for any cut section; therefore, the likelihood of any two luggage units having an identical appearance (i.e., identical locations for the various parts of the composite graffiti design is small. The cut pieces are joined together in a conventional manner, such as sewing, gluing or other known techniques to form the luggage unit, after which the various handles, zippers and other accessories to the luggage unit are attached.

The luggage unit may be of any type and configuration. The luggage unit illustrated in FIGS. 1-5 is a carry-on unit of luggage having wheels, a retractable handle, and several compartments. Other larger or smaller units of any configuration may be made according to the method of the present invention.

Figure 7:
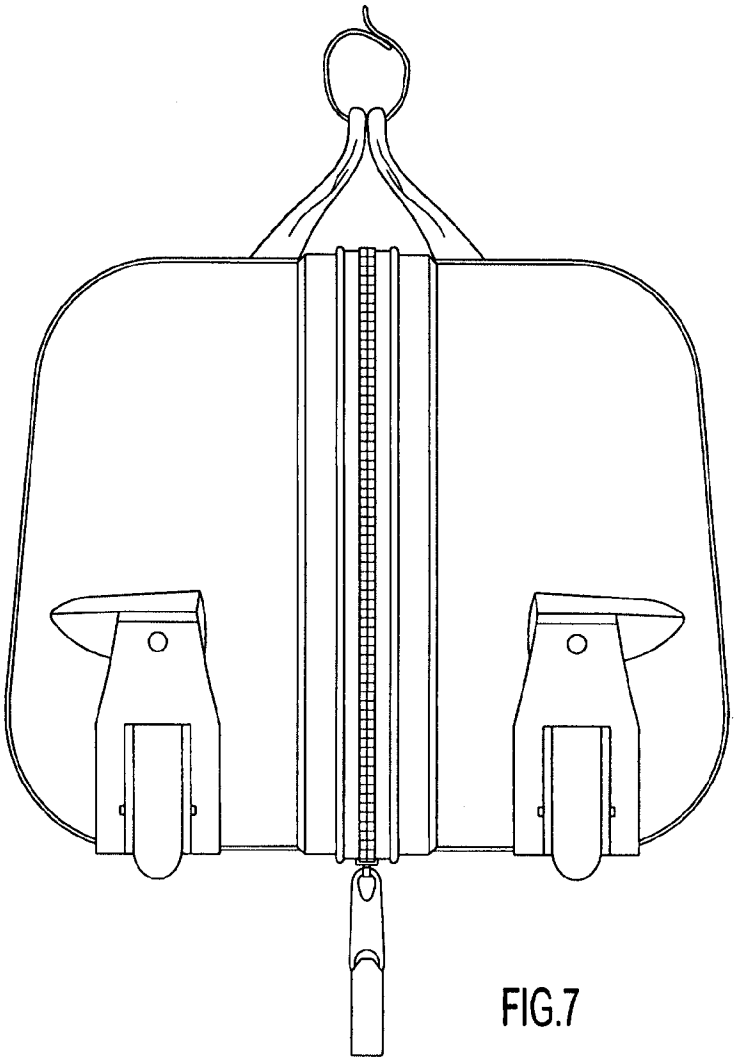
FIG. 7 is a view in perspective of the sheet of material of FIG. 6 showing the material edge in detail.
Figure 6:
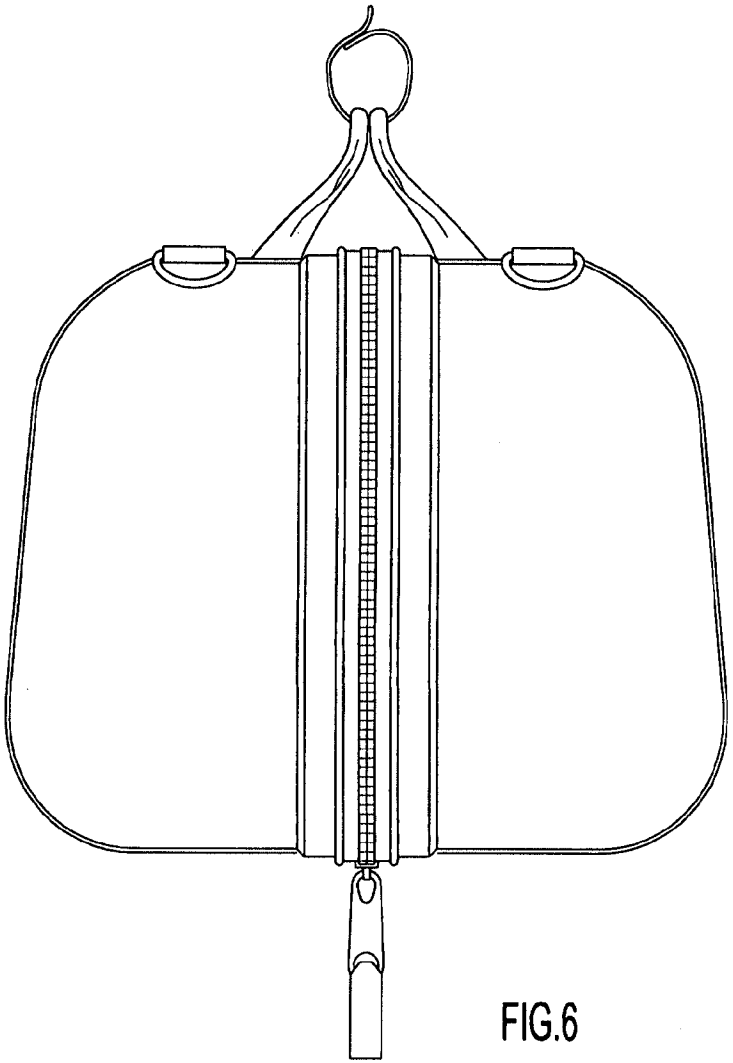
FIG. 6 is a view in plan of a sheet of material containing a design according to the present invention and used to make the unit of FIG. 1.
Figure 1:
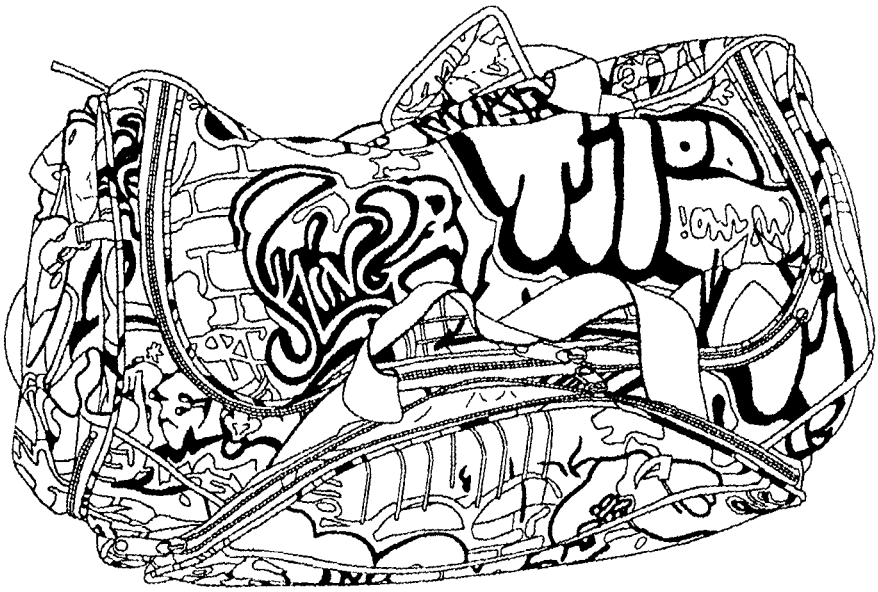
Figure 2:
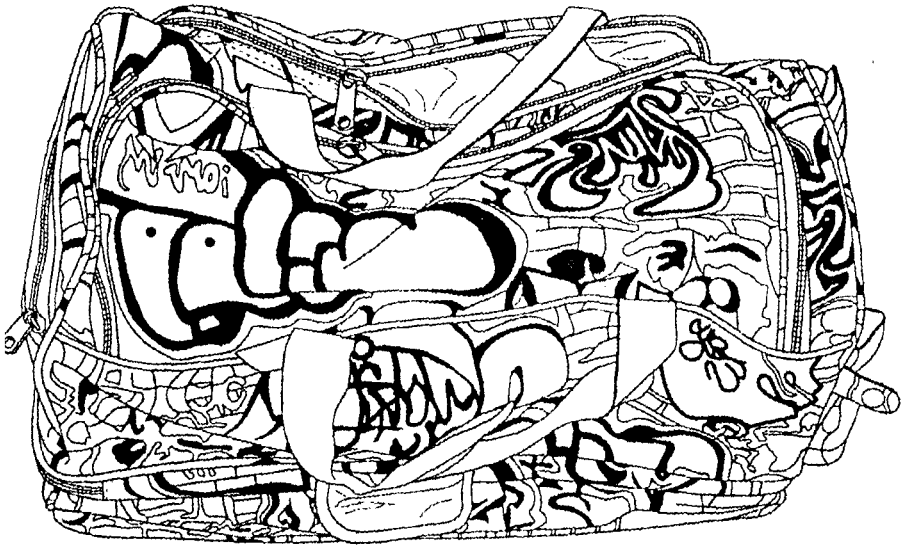
Figure 3:
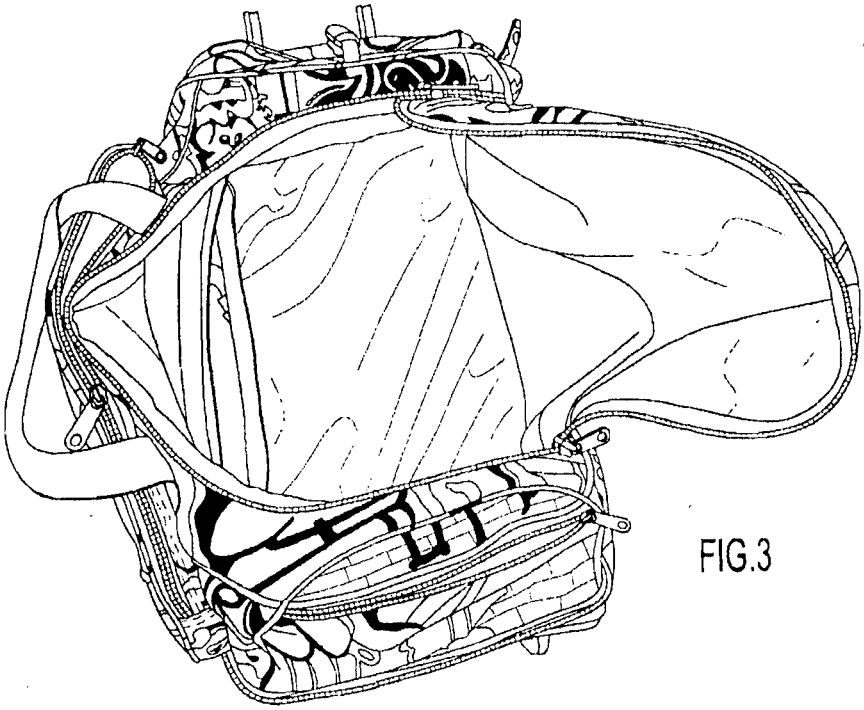
Figure 4:
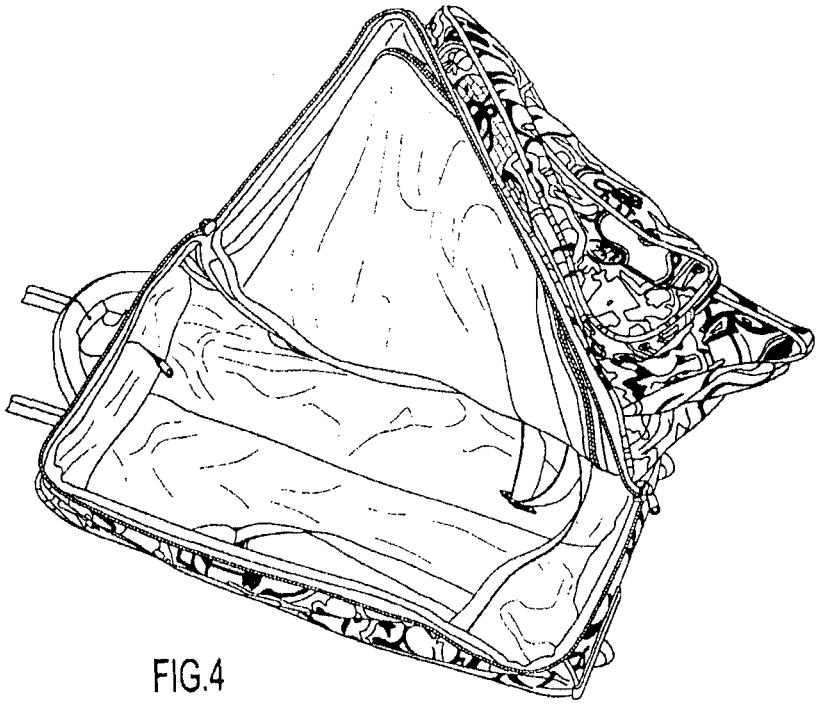
Figure 5:
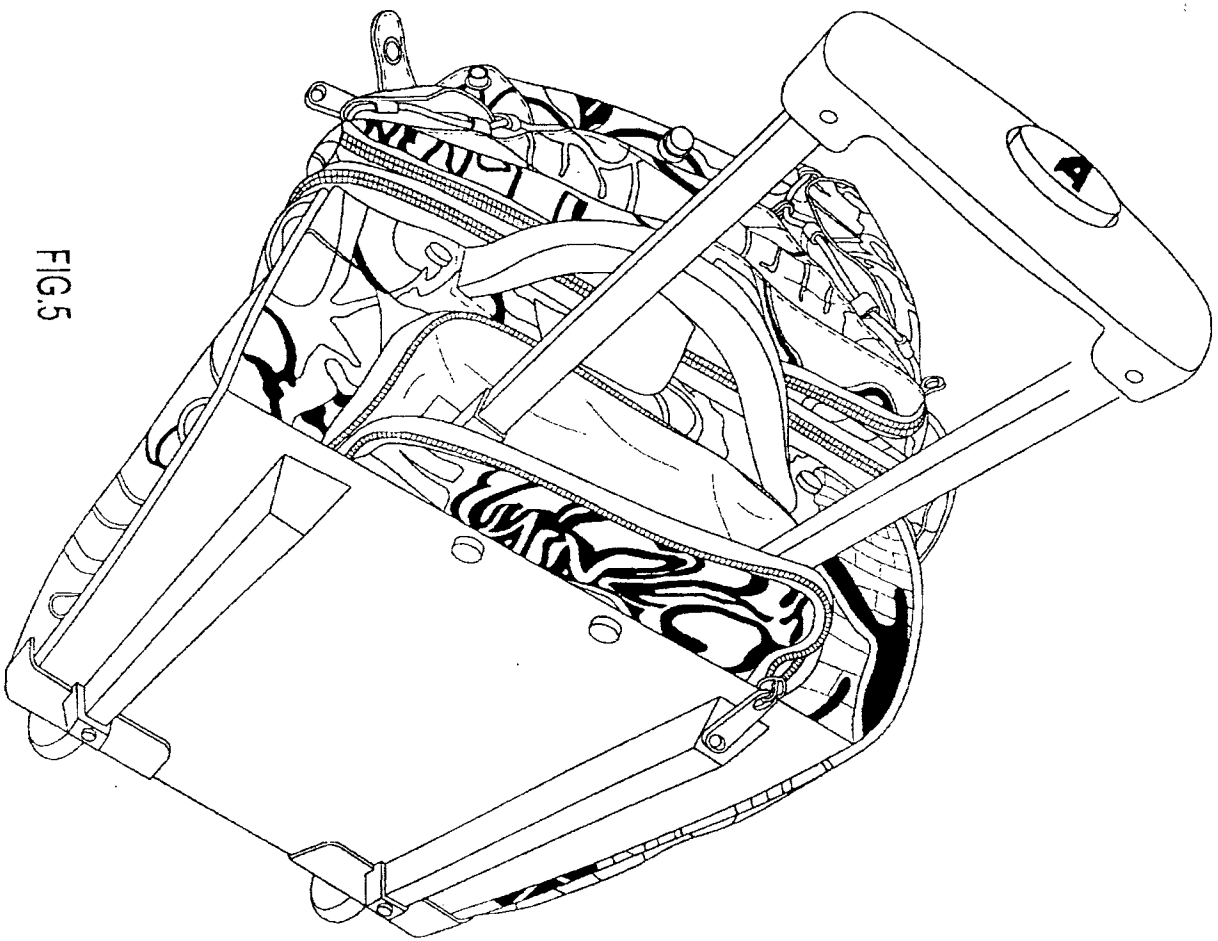
Figure 6:
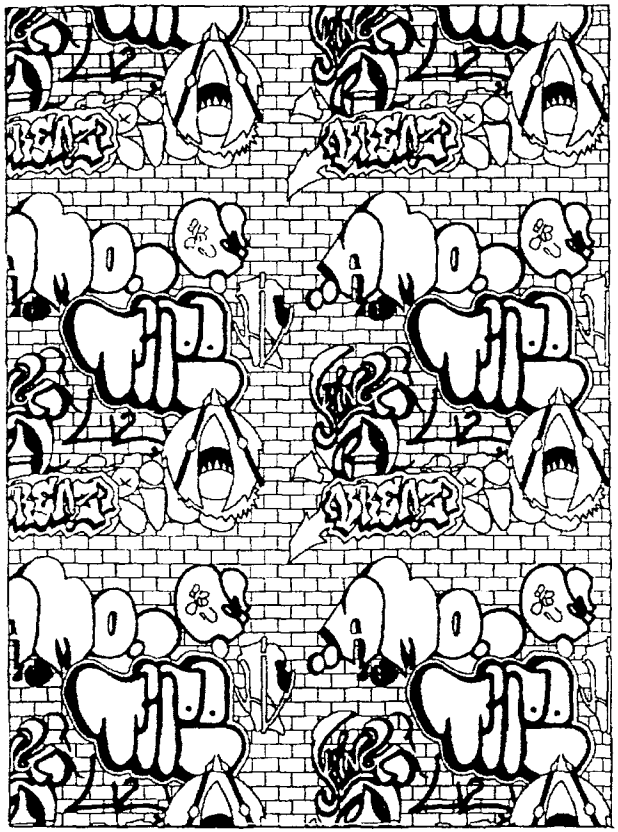
Figure 7:
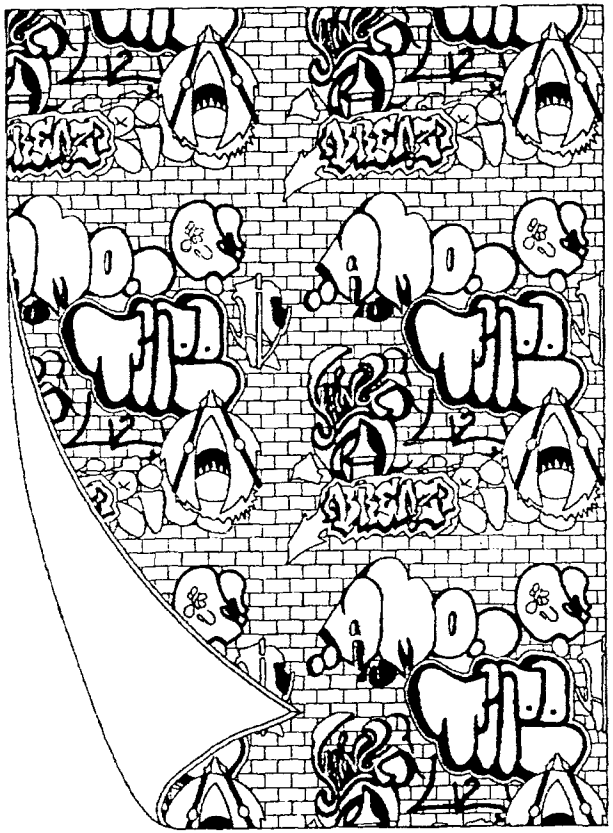

FIGS. 6 and 7 show a piece of material imprinted with a repeating pattern of graffiti according to the invention with the backing attached to the fabric bearing the pattern.

Having described preferred embodiments of new and improved Luggage With Graffiti Patterns And Method Of Manufacturing Same, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A method of fabricating a unit of luggage having an outer surface with an artistic final graffiti design comprising the steps of:

(a) selecting one or more visually appealing street graffiti scenes appearing on a substantially flat surface of one or more structures, wherein the step of selecting includes choosing the graffiti scenes on the basis of their visual appeal and considering the base color of the flat surface with respect to how it impacts the graffiti appearing thereon and the artistic final graffiti design;

(b) taking several digital photographs of each selected graffiti scene from predetermined lines of sight relative to the flat surface bearing the graffiti scene;

(c) determining from an artistic point of view which of said several photographs may best be combined and how they may best be oriented to yield the artistic final graffiti design, wherein the line of sight is substantially the same for all of the determined photographs;

(d) artistically digitally processing the determined photographs, wherein said processing includes one or more of cropping and changing color, tint, contrast and focus with a view toward providing the artistic final graffiti design;

(e) digitally combining the processed photographs as one image to result in a composite visually appealing design image constituting the artistic final design;

(f) transferring the composite design image to a fabric in continuously repeating sections;

(g) cutting the fabric according to patterns corresponding to respective parts of the unit of luggage; and (h) joining the cut parts to form the luggage unit.

2. The method of claim 1 wherein step (g) comprises cutting the fabric in random parts of the repeating sections, whereby the likelihood of any two luggage units having an identical appearance is small.

3. The method of claim 2 wherein step (f) includes the step of transferring the composite design to a roll of the fabric from which the random parts of repeating sections are then cut in step (g).

4. The method of claim 3 further comprising the step of securing a backing to the fabric after step (f) and prior to step (g).

5. The method of claim 3 wherein said transferring is done by a roller printing technique wherein the composite visually appealing design image resulting from step (e) is engraved onto a roller containing a paste or other material for each color.

6. The method of claim 1 further comprising the step of securing a backing to the fabric after step (f) and prior to step (g).

7. The method of claim 6 wherein step (g) comprises cutting the backed fabric in random parts of the repeating sections, whereby the likelihood of any two luggage units having an identical appearance is small.

* * * * *

UNITED STATES PATENT AND TRADEMARK OFFICE

CERTIFICATE OF CORRECTION

PATENT NO. : 8,132,311 B1
APPLICATION NO. : 12/263961
DATED : March 13, 2012
INVENTOR(S) : Andrew Nitkin It is certified that error appears in the above-identified patent and that said Letters Patent is hereby corrected as shown below:

Column 2, line 65, replace “This cuffing results” with -- This cutting results --.

Signed and Sealed this
Eighth Day of May, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,132,311 B1
APPLICATION NO. : 12/263961
DATED : March 13, 2012
INVENTOR(S) : Andrew Nitkin It is certified that error appears in the above-identified patent and that said Letters Patent is hereby corrected as shown below:

The title page showing the illustrative figure should be deleted to be replaced with the attached title page.

In the Drawings

In the drawing sheets, consisting of Figs. 1-7, should be deleted to be replaced with the drawing sheets, consisting of Figs. 1-7, as shown on the attached pages.

Signed and Sealed this
Ninth Day of December, 2014

Michelle K. Lee

Michelle K. Lee
*Deputy Director of the United States Patent and Trademark Office*

(12) United States Patent
Nitkin

(10) Patent No.: US 8,132,311 B1
(45) Date of Patent: Mar. 13, 2012

(54) LUGGAGE WITH GRAFFITI PATTERNS AND METHOD OF MANUFACTURING SAME

(76) Inventor: Andrew Nitkin, New York, NY (US)

( * ) Notice: Subject to any disclaimer, the term of this patent is extended or adjusted under 35 U.S.C. 154(b) by 551 days.

(21) Appl. No.: 12/263,961

(22) Filed: Nov. 3, 2008

Related U.S. Application Data

(60) Provisional application No. 60/984,765, filed on Nov. 2, 2007.

(51) Int. Cl.
*B23P 25/00* (2006.01)

(52) U.S. Cl. ..... 29/458

(58) Field of Classification Search ..... 29/458, 29/416, 417, 428, 419.1, 425; 446/268; 190/125, 190/124
See application file for complete search history.

(56) References Cited

U.S. PATENT DOCUMENTS

2010/0075569 A1* 3/2010 Carnegie ..... 446/268
* cited by examiner

*Primary Examiner* — John C Hong

(57) ABSTRACT

A method for fabricating a unit of luggage includes photographing one or more graffiti scenes, photographically processing the resulting images to yield a composite design image, transferring the composite design image to a sheet of fabric material in a repeating design, cutting the fabric to form pieces of the luggage unit and joining the cut pieces form the luggage unit.

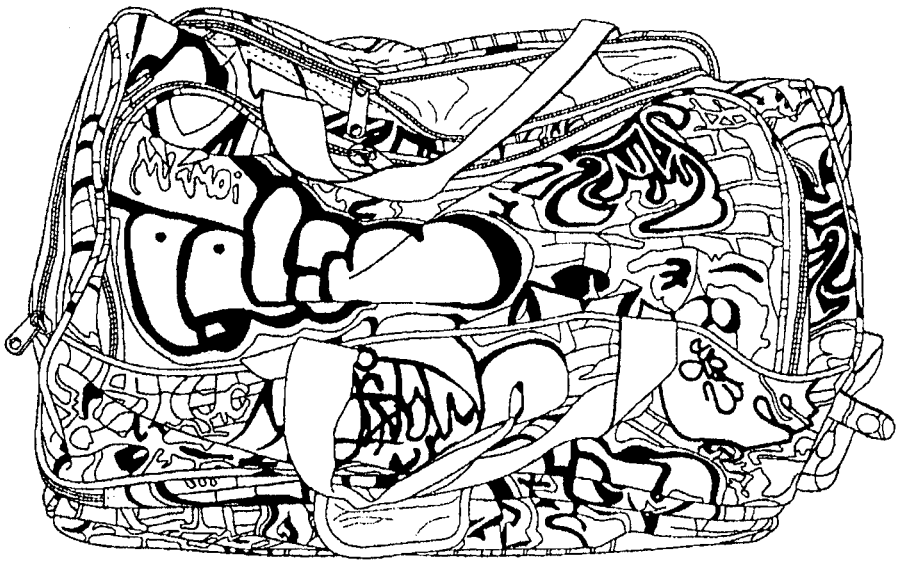

7 Claims, 4 Drawing Sheets